US011304004B2

(12) United States Patent
Noguchi

(10) Patent No.: US 11,304,004 B2
(45) Date of Patent: Apr. 12, 2022

(54) VEHICLE SPEAKER ARRANGEMENT

(71) Applicant: HONDA MOTOR CO., LTD., Tokyo (JP)

(72) Inventor: Kohei Noguchi, Tokyo (JP)

(73) Assignee: HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 17/192,124

(22) Filed: Mar. 4, 2021

(65) Prior Publication Data

US 2021/0306747 A1 Sep. 30, 2021

(30) Foreign Application Priority Data

Mar. 31, 2020 (JP) ..... JP2020-061878

(51) Int. Cl.
*H04R 3/12* (2006.01)
*H04R 1/40* (2006.01)
*H04R 1/02* (2006.01)

(52) U.S. Cl.
CPC ..... *H04R 3/12* (2013.01); *H04R 1/025* (2013.01); *H04R 1/403* (2013.01); *H04R 2201/403* (2013.01); *H04R 2430/20* (2013.01); *H04R 2499/13* (2013.01)

(58) Field of Classification Search
CPC ..... H04R 3/12; H04R 1/025; H04R 1/403; H04R 2201/403; H04R 2430/20; H04R 2499/13; G10K 11/175; G10K 11/1752; G10K 2210/128; G10K 2210/1282
See application file for complete search history.

(56) References Cited

U.S. PATENT DOCUMENTS

| | | | | |
|---|---|---|---|---|
| 10,418,019 | B1 * | 9/2019 | Murad | G10K 11/1754 |
| 2006/0262935 | A1 * | 11/2006 | Goose | H04S 3/002 381/17 |
| 2015/0137998 | A1 * | 5/2015 | Marti | G10K 11/1754 340/901 |
| 2017/0316773 | A1 * | 11/2017 | Walther | H04K 3/84 |
| 2019/0098430 | A1 * | 3/2019 | Matsumura | H04R 5/02 |
| 2019/0130887 | A1 * | 5/2019 | Kotegawa | H04R 3/002 |
| 2020/0388266 | A1 * | 12/2020 | You | G10K 11/17873 |

FOREIGN PATENT DOCUMENTS

JP 2007-235864 9/2007

* cited by examiner

*Primary Examiner* — Jason R Kurr
(74) *Attorney, Agent, or Firm* — Rankin, Hill & Clark LLP

(57) ABSTRACT

A vehicle includes a first voice output section, a second voice output section, and a third voice output section which are arranged side by side in a vehicle width direction of the vehicle. If the vehicle speed is a first threshold or less, the vehicle causes at least one of the first voice output section, second voice output section, and third voice output section to output noise sound.

8 Claims, 12 Drawing Sheets

VEHICLE SPEAKER ARRANGEMENT

INCORPORATION BY REFERENCE

The present application claims priority under 35 U.S.C. § 119 to Japanese Patent Application No. 2020-061878 filed on Mar. 31, 2020. The content of the application is incorporated herein by reference in its entirety.

TECHNICAL FIELD

The present invention relates to a vehicle.

BACKGROUND ART

In the past, a technique which prevents a voice from being heard by a third person has been known. For example, Patent Literature 1 describes a voice processing device which outputs a second voice so as to cover a first voice of a person participating in a meeting. The device includes an audio image position localizing means to localize the audio image of the second voice so that a third person other than a speaking person perceives that the second voice has been output from the position of the speaking person.

CITATION LIST

Patent Literature

[Patent Literature 1] JP-A No. 2007-235864

SUMMARY OF INVENTION

Technical Problem

In the recent years, due to the development of hands-free calling, a phone call on a vehicle such as a motorcycle has become possible. In vehicles too, there is a need to prevent the content of a conversation from being heard by a third person.

The present invention has been achieved in view of the abovementioned circumstances, and it is an object thereof to provide a vehicle which suppresses the possibility that the voice is heard by a third person.

Solution to Problem

In order to achieve the object, according to a first feature of the present invention, there is provided a vehicle (1) which includes a plurality of voice output sections (151), (153), and (155) arranged side by side in the vehicle width direction of the vehicle (1). If the vehicle speed of the vehicle (1) is a first threshold or less, the vehicle (1) causes at least one of the plural voice output sections to output noise sound.

According to a second feature of the present invention, in addition to the first feature, the plural voice output sections (151), (153), and (155) are arranged side by side in the vehicle width direction and if the vehicle speed is the first threshold or less, the vehicle (1) may cause the voice output sections (151) and (155) among the plural voice output sections to output the noise sound, in which the voice output sections (151) and (155) are located outward in the vehicle width direction.

According to a third feature of the present invention, in addition to the first or second feature, the plural voice output sections (151), (153), and (155) include a first voice output section (151), a second voice output section (153), and a third voice output section (155). The vehicle (1) includes a voice input section (140) which receives a voice signal, and if the vehicle speed is the first threshold or less, the vehicle (1) may cause the first voice output section (151) and the third voice output section (155) to output the noise sound and cause the second voice output section (153) to output voice based on the voice signal received by the voice input section (140), in which the first voice output section (151) and the third voice output section (155) are located outward in the vehicle width direction and the second voice output section (153) is located between the first voice output section (151) and the third voice output section (155).

According to a fourth feature of the present invention, in addition to the third feature, if the vehicle speed is a second threshold or more, the vehicle (1) may cause the first voice output section (151), the second voice output section (153), and the third voice output section (155) to output the voice based on the voice signal.

According to a fifth feature of the present invention, in addition to the fourth feature, if the vehicle speed is less than the second threshold, the vehicle (1) may control the first voice output section (151) and the third voice output section (155) to decrease the sound volume of the noise sound gradually according to an increase in the vehicle speed.

According to a sixth feature of the present invention, in addition to any one of the third to fifth features, the first voice output section (151), the second voice output section (153), and the third voice output section (155) each include speakers (171 to 178) and the speakers (171, 172, 177, 178) of the first voice output section (151) and the third voice output section (155) may be arranged in a manner to be oriented outward in the vehicle width direction.

According to a seventh feature of the present invention, in addition to the first feature, the plural voice output sections (151), (153), (155) and (157) include a first voice output section (151), a second voice output section (153), a third voice output section (155), and a fourth voice output section (157), in which the first voice output section (151), the second voice output section (153), and the third voice output section (155) are located forward in the vehicle (1) and the fourth voice output section is located rearward in the vehicle (1). The first voice output section (151), the second voice output section (153), and the third voice output section (155) are arranged side by side in the vehicle width direction and output voice rearward in the vehicle (1). The fourth voice output section (157) is located in a position to face the second voice output section (153) with a seat (51, 53) for an occupant to sit on being sandwiched. The vehicle (1) includes a voice input section (140) which receives a voice signal and may cause the second voice output section (153) to output voice based on the voice signal received by the voice input section (140) and cause the fourth voice output section (157) to output voice with an opposite phase to the voice based on the voice signal.

According to an eighth feature of the present invention, in addition to the seventh feature, if the vehicle speed is the first threshold or less, the vehicle (1) may cause the first voice output section (151) and the third voice output section (155) to output the noise sound and cause the second voice output section (153) to output voice based on the voice signal received by the voice input section (140), in which the first voice output section (151) and the third voice output section (155) are located outward in the vehicle width direction and the second voice output section (153) is located between the first voice output section (151) and the third voice output section (155).

According to a ninth feature of the present invention, in addition to the eighth feature, the vehicle (1) includes a delay section (107) to delay timing of voice output and may delay the timing of voice output from the second voice output section (153) to make the timing of voice output from the second voice output section (153) be the timing of voice output from the fourth voice output section (157).

Advantageous Effects of Invention

With the first feature, the vehicle includes a plurality of voice output sections arranged side by side in the vehicle width direction of the vehicle and if the vehicle speed of the vehicle is the first threshold or less, the vehicle causes at least one of the plural voice output sections to output noise sound.

According to this feature, it is possible to suppress the possibility that voice is heard by a third person in the vehicle.

With the second feature, the plural voice output sections are arranged side by side in the vehicle width direction, and if the vehicle speed is the first threshold or less, the vehicle causes the voice output sections located outward in the vehicle width direction among the plural voice output sections to output the noise sound.

According to this feature, it is possible to suppress the possibility that voice is heard by a third person walking at an end in the width direction of a road on which the vehicle is traveling or on a pathway provided at an end of the road.

With the third feature, the plural voice output sections include a first voice output section, a second voice output section, and a third voice output section and the vehicle includes the voice input section which receives a voice signal. If the vehicle speed is the first threshold or less, the vehicle causes the first voice output section and the third voice output section located outward in the vehicle width direction to output the noise sound and causes the second voice output section located between the first voice output section and the third voice output section to output voice based on the voice signal received by the voice input section.

According to this feature, an occupant of the vehicle can hear the voice received by the voice input section and it is possible to suppress the possibility that the voice received by the voice input section is heard by a third person walking at an end in the width direction of the road.

With the fourth feature, if the vehicle speed is the second threshold or more, the vehicle causes the first voice output section, the second voice output section, and the third voice output section to output the voice based on the voice signal.

According to this feature, if the vehicle speed of the vehicle is the second threshold or more and the possibility of the voice received by the voice input section being heard by a third person is lowered, the first voice output section and third voice output section also output the voice received by the voice input section so that the occupant of the vehicle can hear the voice received by the voice input section more easily.

With the fifth feature, if the vehicle speed is less than the second threshold, the vehicle controls the first voice output section and the third voice output section to decrease the sound volume of the noise sound gradually according to an increase in the vehicle speed.

According to this feature, if the vehicle speed of the vehicle increases and the possibility of the voice being heard by a third person is lowered, the noise sound is gradually lowered so that the occupant can hear the voice received by the voice input section more easily.

With the sixth feature, the first voice output section, the second voice output section, and the third voice output section each include speakers, and the speakers of the first voice output section and the third voice output section are arranged in a manner to be oriented outward in the vehicle width direction.

According to this feature, the noise sound can be output outward in the width direction of the road effectively.

With the seventh feature, the plural voice output sections include a first voice output section, a second voice output section, a third voice output section, and a fourth output section, in which the first voice output section, the second voice output section, and the third voice output section are located forward in the vehicle and the fourth voice output section is located rearward in the vehicle. The first voice output section, the second voice output section, and the third voice output section are arranged side by side in the vehicle width direction and output voice rearward in the vehicle. The fourth voice output section is located in a position to face the second voice output section with the seat for an occupant to sit on being sandwiched. The vehicle includes the voice input section which receives a voice signal. The vehicle causes the second voice output section to output voice based on the voice signal received by the voice input section, and causes the fourth voice output section to output voice with an opposite phase to the voice based on the voice signal.

According to this feature, it is possible to suppress the possibility that the voice received by the voice input section is heard by a pillion passenger of the vehicle.

With the eighth feature, if the vehicle speed is the first threshold or less, the vehicle causes the first voice output section and the third voice output section located outward in the vehicle width direction to output the noise sound and causes the second voice output section located between the first voice output section and the third voice output section to output voice based on the voice signal received by the voice input section.

According to this feature, the occupant of the vehicle can hear the voice received by the voice input section and it is possible to suppress the possibility that the voice received by the voice input section is heard by a third person walking at an end in the width direction of the road.

With the ninth feature, the vehicle includes the delay section to delay the timing of voice output, and delays the timing of voice output from the second voice output section to make the timing of voice output from the second voice output section be the timing of voice output from the fourth voice output section.

According to this feature, the timing of output of voice with an opposite phase from the fourth voice output section can coincide with the timing of voice output from the second voice output section and it is possible to enhance the effect to suppress the possibility that the voice based on the voice signal received by the voice input section is heard by the pillion passenger.

DESCRIPTION OF EMBODIMENTS

First Embodiment

Next, a first embodiment of the present invention will be described referring to drawings. In the description below, direction-related words such as front, back, left, right, and up and down are the same as those with respect to the vehicle body unless otherwise specified. In each drawing, sign FR represents forward of the vehicle body, sign UP represents upward of the vehicle body, sign LH represents left of the vehicle body, and sign RH represents right of the vehicle body.

Figure 1:
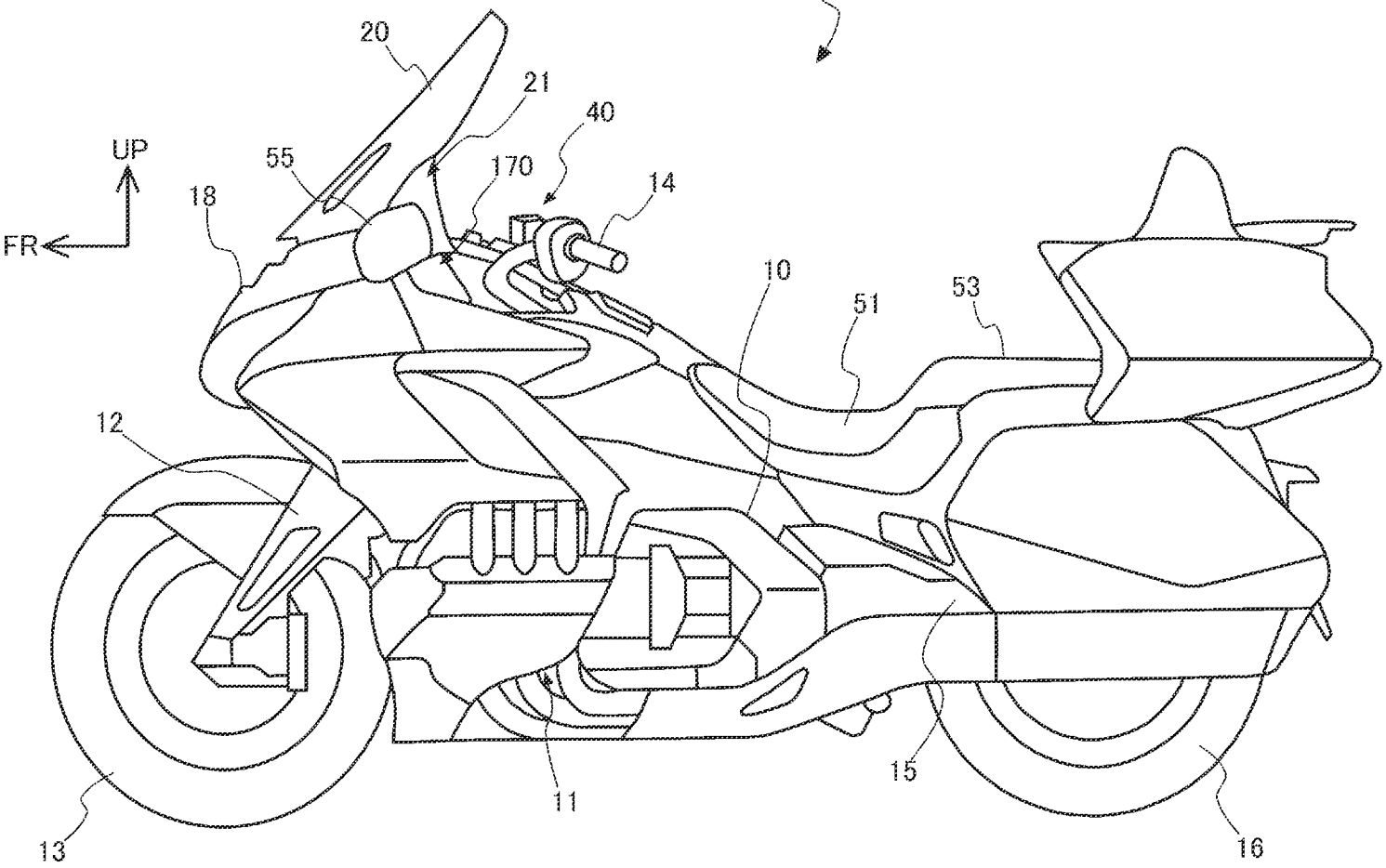
FIG. 1 is a side view of a motorcycle.
Figure 2:
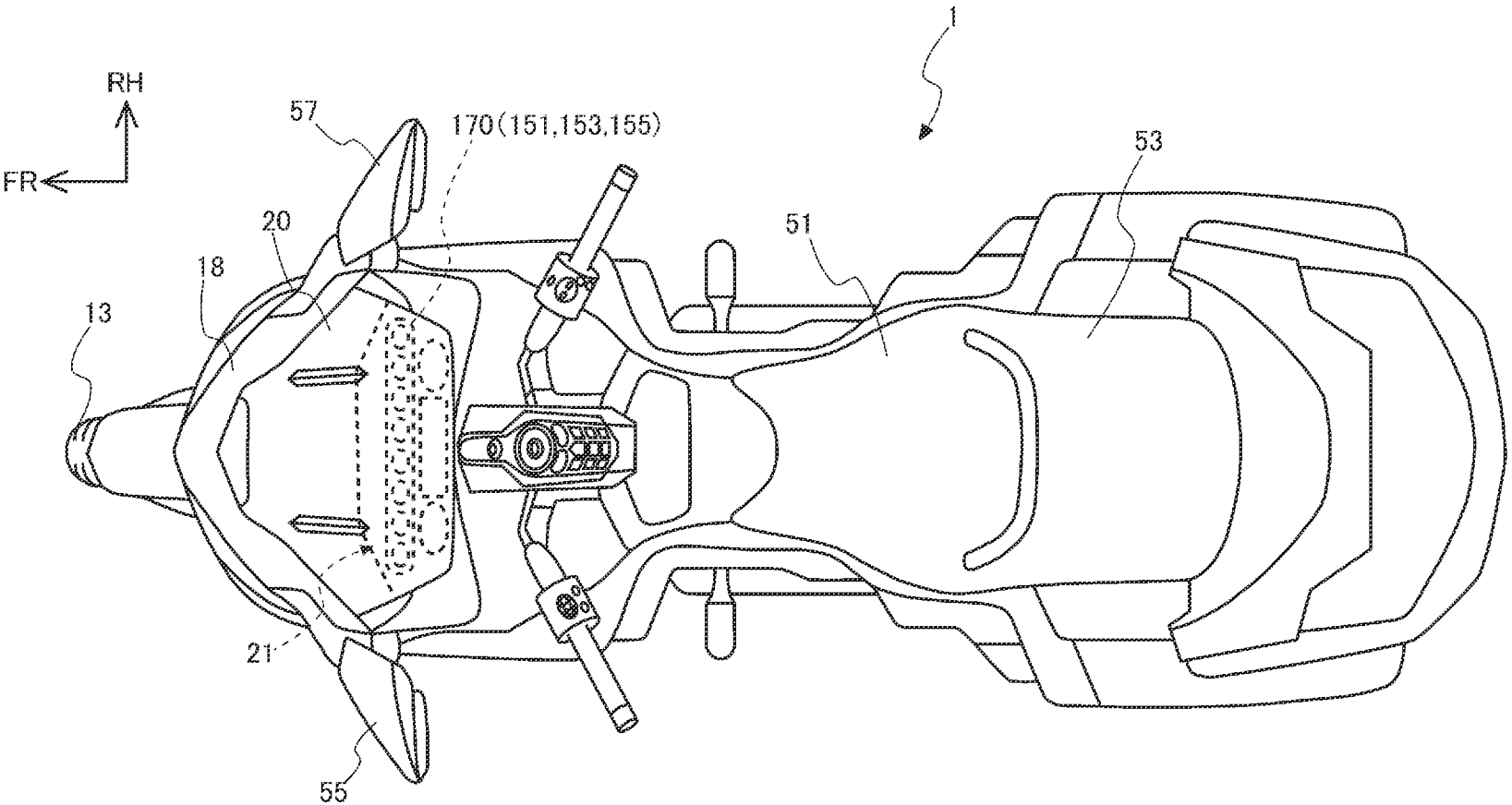
FIG. 2 is a top view of the motorcycle.
Figure 3:
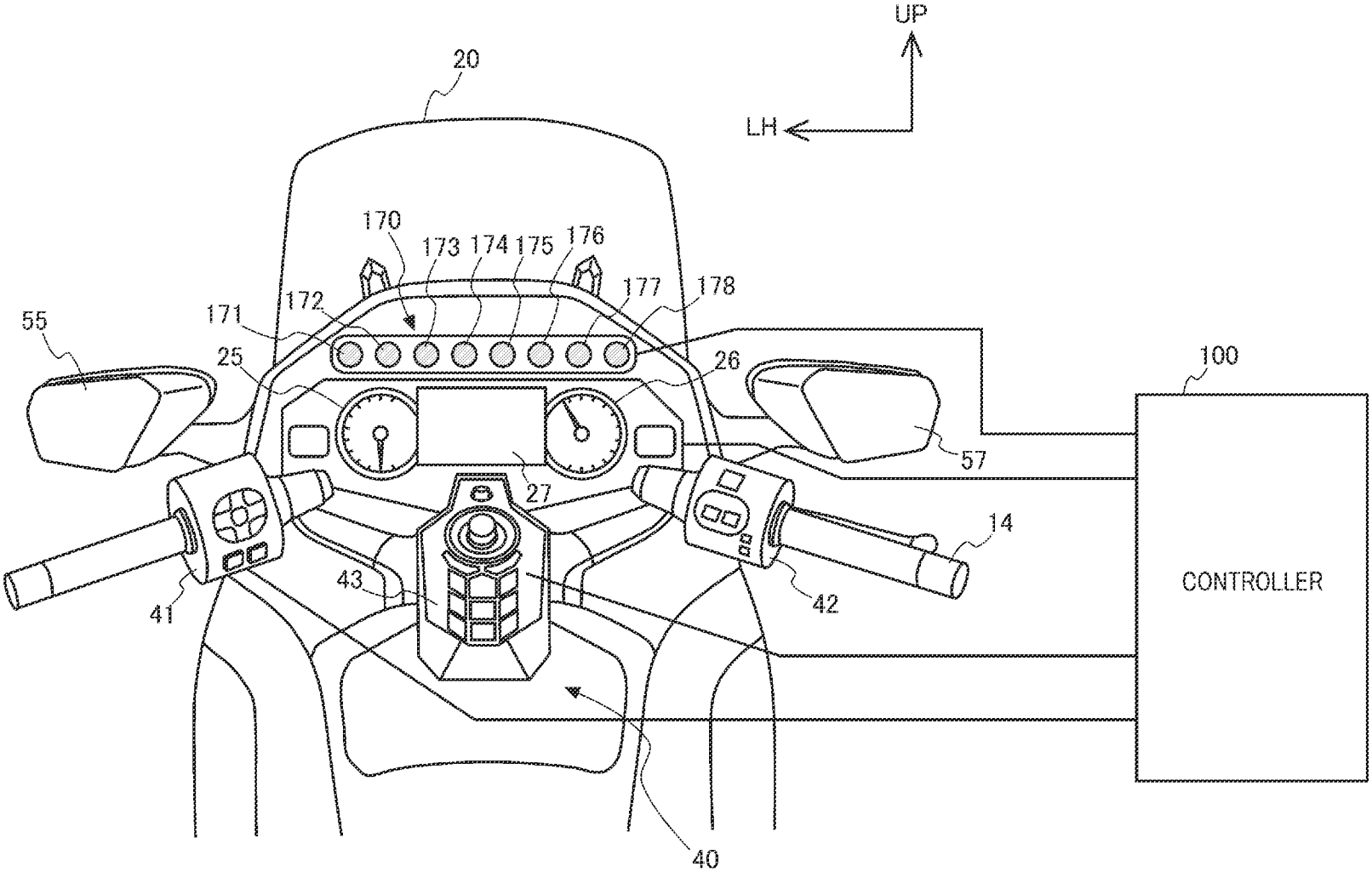
FIG. 3 is a view of the motorcycle as viewed forward from the rear.

FIG. 1 is a side view of a motorcycle according to an embodiment of the present invention; FIG. 2 is a top view of the motorcycle; and FIG. 3 is a view of the motorcycle as viewed forward from the rear. In this specification, a motorcycle is referred to as vehicle 1, but vehicle 1 is not limited to a motorcycle.

As shown in FIG. 1, the vehicle 1 includes a body frame 10 and a power unit 11 which is supported by the body frame 10. In the front portion of the body frame 10, a front wheel 13 is transversely steerably supported through a front fork 12 which also functions as a front cushion and a steering handlebar 14 is provided at the top of the front fork 12. In the rear lower portion of the body frame 10, a rear wheel 16 is vertically swingably supported through a swing arm 15 and a pillion passenger seat 53 is interposed between the body frame 10 and the swing arm 15. The power unit 11 includes an engine and a transmission mechanism and rotatively drives the rear wheel 16 through a shaft drive mechanism.

As shown in FIG. 2, behind the steering handlebar 14, the body frame 10 supports a rider seat 51 for a rider to sit on and the pillion passenger seat 53 for a pillion passenger to sit on and also supports a body cover 18 covering almost the whole body frame 10. A front screen 20 or the like which covers an area in front of an occupant is attached to the body cover 18. A meter panel 21 and a speaker array 170 are arranged between the front screen 20 and the steering handlebar 14, in which the meter panel 21 shows various types of information and the speaker array 170 functions as a speaker unit. A manipulation portion 40 for menu selection or the like in the meter panel 21 is located around the steering handlebar 14. Also, a left mirror 55 and a right mirror 57 are located on the body cover 18. The left mirror 55 and right mirror 57 are located outside of the front screen 20 in the vehicle width direction of the vehicle 1.

In the vehicle 1, a controller 100 which is electrically connected with the meter panel 21, speaker array 170, and manipulation portion 40 is mounted. The controller 100 controls the display content of the meter panel 21 and the output voice from the speaker array 170 and also receives various instructions from the rider through the manipulation portion 40.

FIG. 3 is a view which shows the area around the meter panel 21 as viewed from the rider, together with the controller 100. The meter panel 21 includes measuring instruments 25 and 26 and a display 27, in which the measuring instruments 25 and 26 show information related to the motorcycle (speed, engine speed, etc.) and the display 27 shows various types of information. The display 27 includes a known display panel such as a liquid crystal panel and displays various types of information for the rider or the like, under the control of the controller 100.

The speaker array 170 is located above the measuring instruments 25 and 26 of the meter panel 21 and the display 27. Since the speaker array 170 is located above the measuring instruments 25 and 26 of the meter panel 21 and the display 27, it is closer to the ears of the rider and can reduce the sound attenuation caused by the steering handlebar or the like.

The speaker array 170 is a speaker unit which includes a plurality of speakers arranged side by side in the width direction of the vehicle 1 and broadens the audible area for the rider or the like in the widthwise direction. The structure is as follows: from left as viewed from the rider, a first speaker 171, a second speaker 172, a third speaker 173, a fourth speaker 174, a fifth speaker 175, a sixth speaker 176, a seventh speaker 177, and an eighth speaker 178 are arranged in a row.

Figure 7:
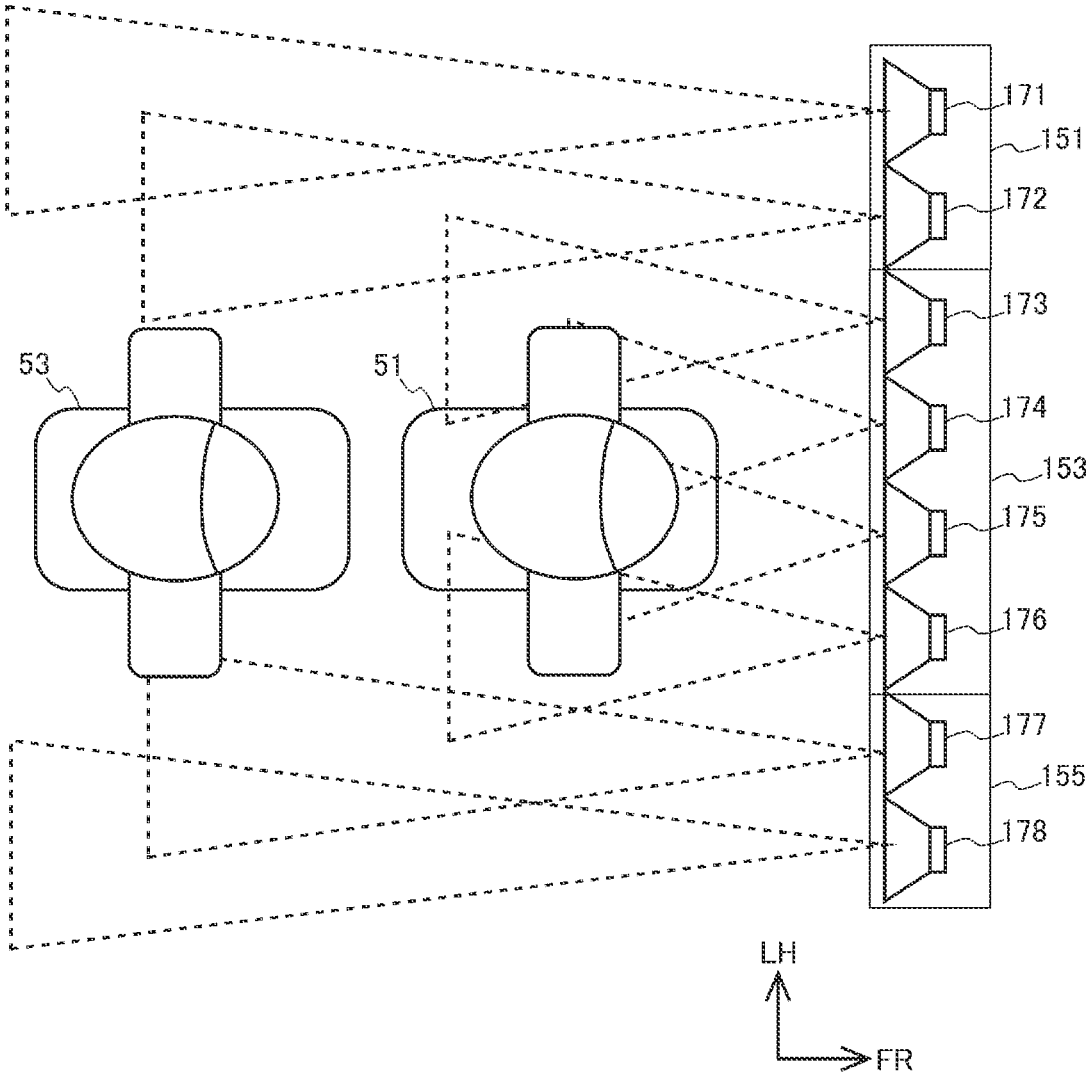
FIG. 7 is a diagram which schematically shows the range in which the voice output from each speaker of the speaker array is transmitted.

The first speaker 171 and second speaker 172 constitute a first voice output section 151 which is located on the left as viewed from the rider (see FIG. 7). The third speaker 173, fourth speaker 174, fifth speaker 175 and sixth speaker 176 constitute a second voice output section 153 which is located in the center in the vehicle width direction (see FIG. 7). The seventh speaker 177 and eighth speaker 178 constitute a third voice output section 155 which is located on a right side as viewed from the rider (see FIG. 7). The numbers of speakers which constitute the first voice output section 151, the second voice output section 153, and the third voice output section 155 are arbitrary and can be changed as appropriate. Due to this structure, even when the heads of the rider and pillion passenger move left or right or the like, the voice from any one of the first voice output section 151, second voice output section 153, and third voice output section 155 can be transmitted to the ears of the rider and pillion passenger.

In the speaker array 170 arranged in a row, the first speaker 171 installed at the left end is located outside of the width of the vehicle 1 in the vehicle width direction and the eighth speaker 178 installed at the right end is located outside of the width of the vehicle 1 in the vehicle width direction. Specifically, the width of the vehicle 1 is the width of the rider seat 51. The first speaker 171 and eighth speaker 178 are located more outward in the vehicle width direction than the ends of the rider seat 51 in the vehicle width direction. Also, the first speaker 171 installed at the left end is located inside of the left mirror 55 in the vehicle width direction and the eighth speaker 178 installed at the right end is located inside of the right mirror 57 in the vehicle width direction.

In addition, in the vehicle 1, the manipulation portion 40 includes left and right handlebar manipulation portions 41 and 42 and a center manipulation portion 43, in which the manipulation portions 41 and 42 are located left and right on the steering handlebar 14 respectively and the center manipulation portion 43 is located between the meter panel 21 and rider seat 51 and in the center position in the vehicle width direction. These manipulation portions 40 include not only a group of switches constituting a general manipulation system to manipulate a light device such as a blinker of the vehicle 1 and turn ON/OFF the power unit 11, but also a group of switches constituting a manipulation system related to the display 27 of the meter panel 21 and the speaker array 170.

Figure 4:
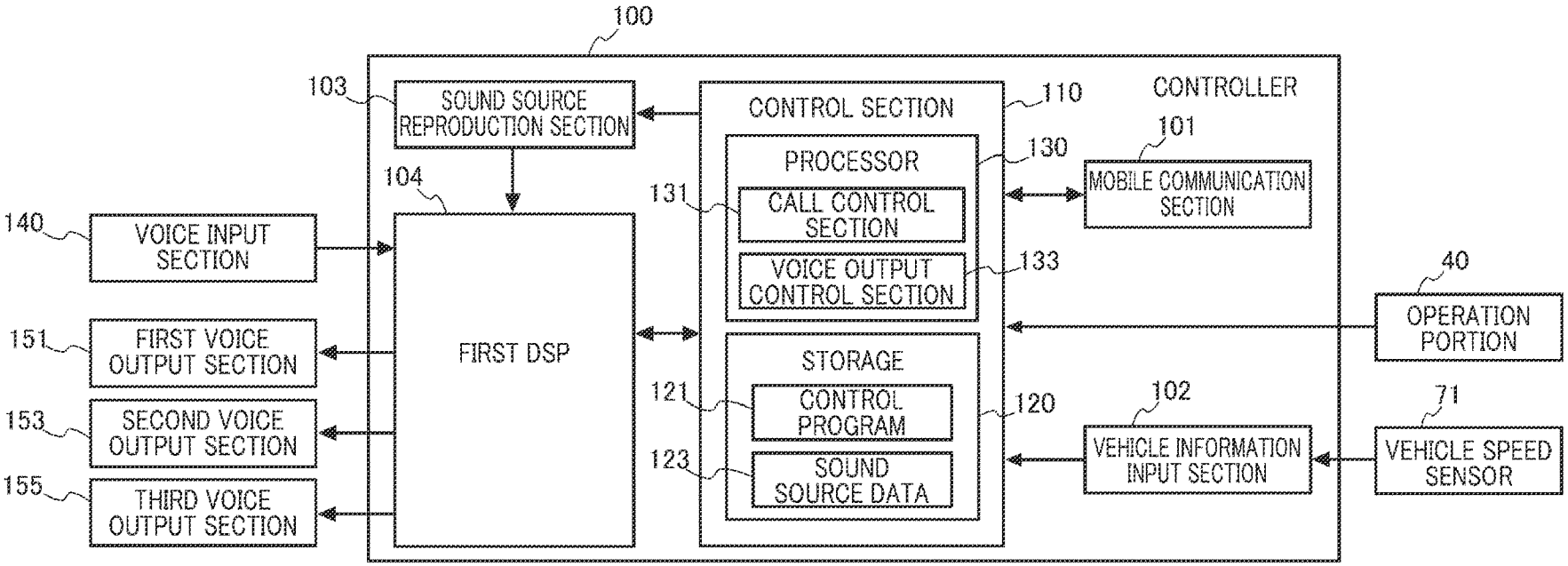
FIG. 4 is a block diagram which shows the configuration of the controller.

FIG. 4 is a block diagram which shows the configuration of the controller 100.

The configuration of the controller 100 is described below referring to FIG. 4.

The controller 100 includes a mobile communication section 101 (transmitter/receiver), a vehicle information input section 102 (circuit), a sound source reproduction section 103 (circuit), a first DSP 104, and a control section 110. DSP is an abbreviation for Digital Signal Processor.

The mobile communication section 101 makes wireless communications according to a prescribed communication protocol and connects to a mobile phone network. The mobile communication section 101 sends and receives communication data through the connected mobile phone network. The communication data includes voice data. The mobile communication section 101 outputs the received communication data to the control section 110.

The vehicle information input section 102 functions as an interface for connection with the vehicle 1 and receives vehicle information output from a sensor or the like mounted in the vehicle 1. In this embodiment, the vehicle information includes sensor data of a vehicle speed sensor 71. The vehicle speed sensor 71 is a sensor which detects the vehicle speed of the vehicle 1. The vehicle sensor 71 detects the vehicle speed of the vehicle 1 and outputs the sensor data indicating the detected vehicle speed, to the controller 100.

The sound source reproduction section 103 reads and reproduces the sound source data 123 stored in a storage 120 of the control section 110. The sound source reproduction section 103 outputs the reproduced audio data to the first DSP 104.

The first DSP 104 receives voice data and audio data, in which the voice data is included in the communication data received by the mobile communication section 101 and the audio data is reproduced by the sound source reproduction section 103. The first DSP 104 generates a voice signal on the basis of the received voice data and audio data. The generated voice signal is an analog signal and generated in a plurality of channels. The first DSP 104 outputs the generated analog voice signal to the first voice output section 151, second voice output section 153, and third voice output section 155.

In addition, the first DSP 104 is connected with a voice input section 140 (circuit).

For example, the voice input section 140 converts the voice of a user into an analog voice signal and outputs it to the first DSP 104. The first DSP 104 converts the voice signal received from the voice input section 140 into a digital signal and outputs it to the control section 110. The voice input section 140 collects the voice of the rider, for example, using an Incom attached to the rider or a microphone previously installed in the vehicle 1. For communications between the voice input section 140 and the controller 100, for example, short-range wireless communication such as Bluetooth is used. Bluetooth is a registered trademark.

Figure 5:
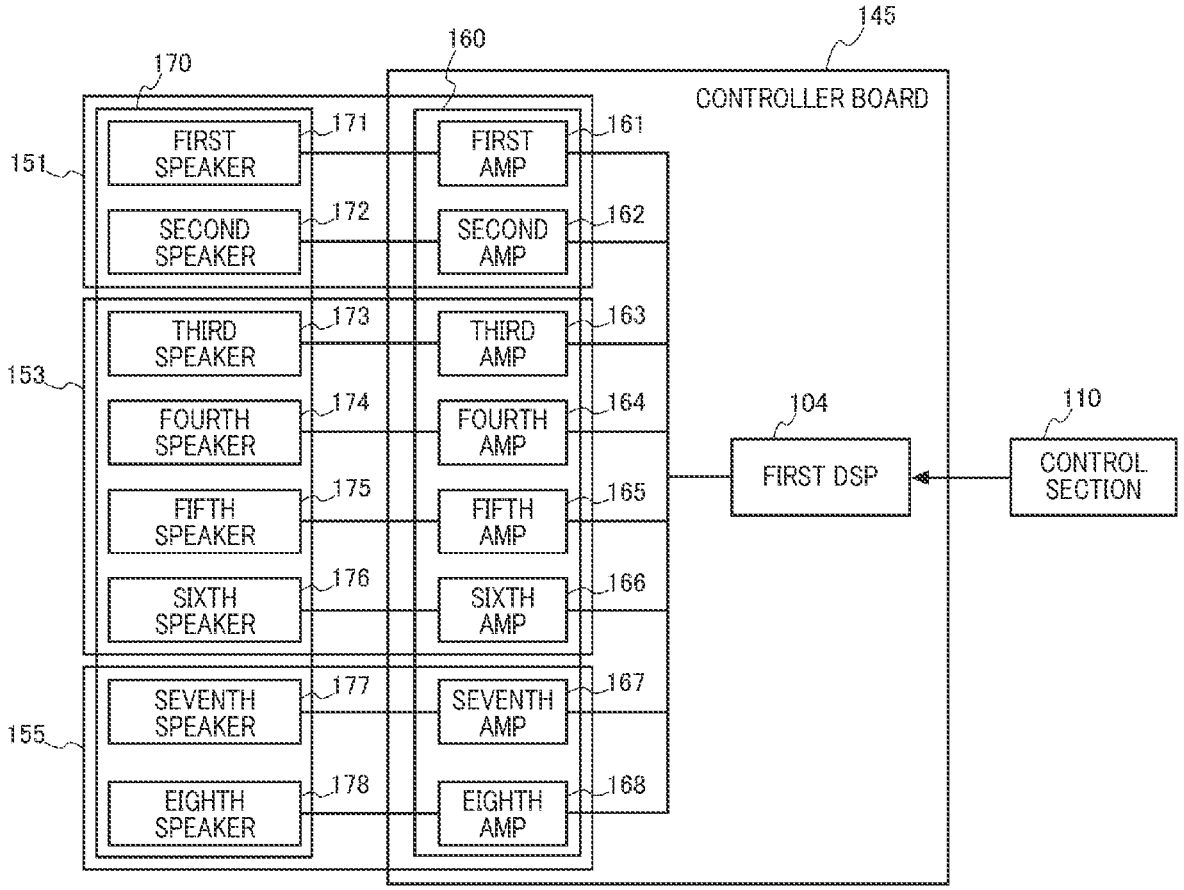
FIG. 5 is a diagram which shows the configuration of the voice output system mounted on the vehicle.

Here, the configuration of a voice output system mounted in the vehicle 1 is described referring to FIG. 5. FIG. 5 is a diagram which shows the configuration of the voice output system of the vehicle 1. The voice output system is mounted on a controller board 145. On the controller board 145, the first DSP 104 and a signal amplifying section 160 are mounted. In addition, a power supply section which supplies battery electric power to the first DSP 104 is mounted on the controller board 145. The power supply section is omitted in the figure.

The signal amplifying section 160 includes a first AMP 161, a second AMP 162, a third AMP 163, a fourth AMP 164, a fifth AMP 165, a sixth AMP 166, a seventh AMP 167, and an eighth AMP 168. AMP is an abbreviation for Amplifier.

The first AMP 161 is connected with the first speaker 171. The second AMP 162 is connected with the second speaker 172. The first AMP 161 amplifies the received voice signal and outputs it to the first speaker 171. The second AMP 162 amplifies the received voice signal and outputs it to the second speaker 172.

The first AMP 161, first speaker 171, second AMP 162, and second speaker 172 constitute the first voice output section 151.

The third AMP 163 is connected with the third speaker 173. The fourth AMP 164 is connected with the fourth speaker 174. The fifth AMP 165 is connected with the fifth speaker 175. The sixth AMP 166 is connected with the sixth speaker 176.

The third AMP 163 amplifies the received voice signal and outputs it to the third speaker 173. The fourth AMP 164 amplifies the received voice signal and outputs it to the fourth speaker 174. The fifth AMP 165 amplifies the received voice signal and outputs it to the fifth speaker 175. The sixth AMP 166 amplifies the received voice signal and outputs it to the sixth speaker 176.

The third AMP 163, third speaker 173, fourth AMP 164, fourth speaker 174, fifth AMP 165, fifth speaker 175, sixth AMP 166 and sixth speaker 176 constitute the second voice output section 153.

The seventh AMP 167 is connected with the seventh speaker 177. The eighth AMP 168 is connected with the eighth speaker 178. The seventh AMP 167 amplifies the received voice signal and outputs it to the seventh speaker 177. The eighth AMP 168 amplifies the received voice signal and outputs it to the eighth speaker 178.

The seventh AMP 167, seventh speaker 177, eighth AMP 168, and eighth speaker 178 constitute the third voice output section 155.

Figure 6A:
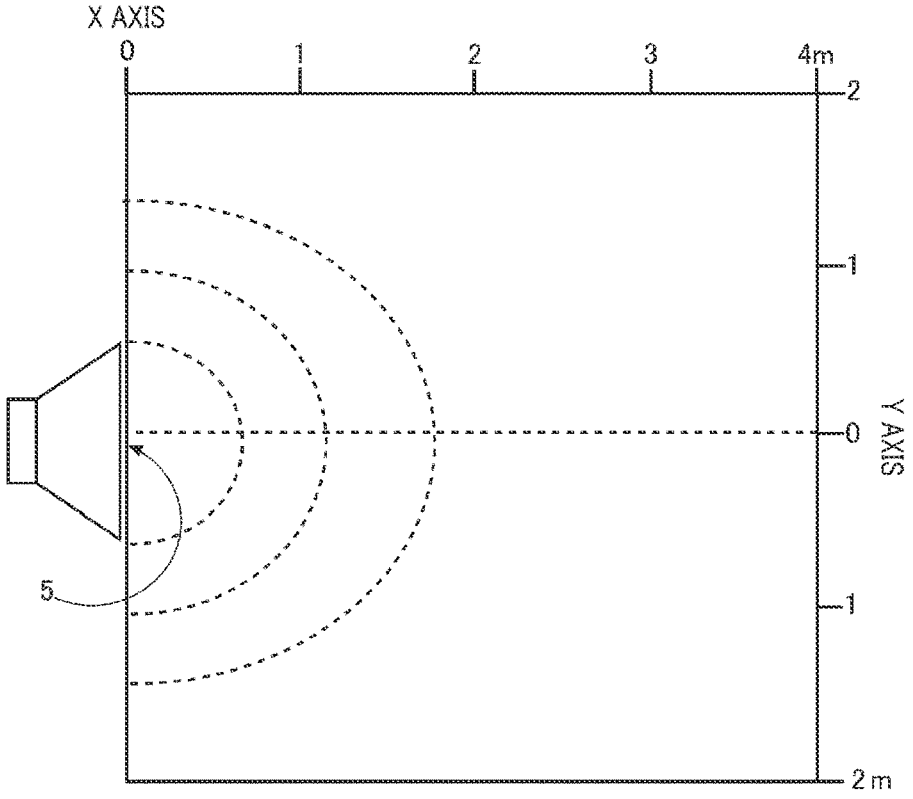
FIGS. 6A and 6B are diagrams which show the directivity of an ordinary speaker and a speaker of a speaker array.
Figure 6B:
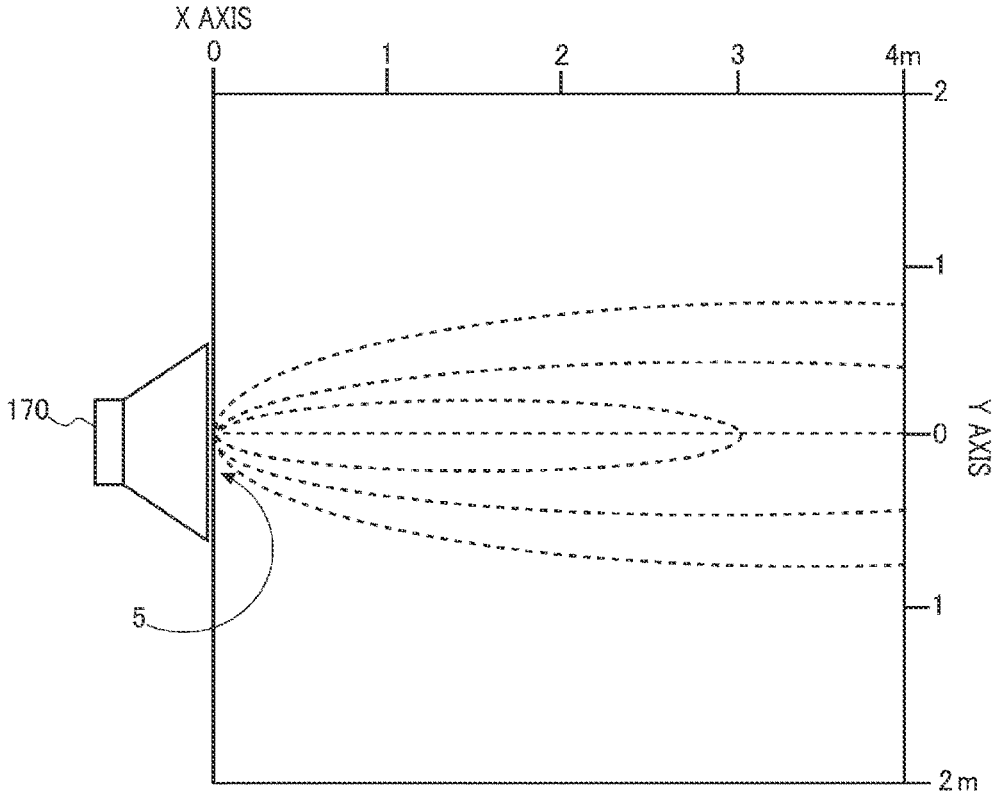

Next, the directivity of the speakers of the speaker array 170 will be described referring to FIGS. 6A and 6B. FIGS. 6A and 6B are diagrams which show the directivity of an ordinary speaker and a speaker of the speaker array 170. A speaker mounted on the vehicle 1 has super-directivity and the voice output from the speaker is high in straightness and sharp in directivity.

The speakers 171 to 178 constituting the speaker array 170 have super-directivity and the voice output from each speaker is high in straightness and sharp in directivity.

FIG. 6A shows the range of transmission of the voice output from a commonly used speaker and FIG. 6B shows the range of transmission of the voice output from a speaker of the speaker array 170 with super-directivity. The horizontal axis in FIG. 6A and FIG. 6B represents distance in the X axis direction and the vertical axis represents distance in the Y axis direction. The X axis direction is a direction perpendicular to a voice output plane 5 of the speaker and the Y axis direction is a direction parallel to the voice output plane 5. The origin in the Y axis direction is set at the center in the Y axis direction of the output plane 5 of the speaker. As apparent from comparison between FIG. 6A and FIG. 6B, it is known that with the speaker mounted on the vehicle 1, the range of transmission in the horizontal direction (transverse direction) is narrow but the voice is far-reaching.

FIG. 7 is a diagram which schematically shows the range in which the voice output from each speaker of the speaker array 170 is transmitted.

As shown in FIG. 7, the second voice output section 153 is located in the center in the vehicle width direction of the vehicle 1. In addition, the third speaker 173 to the sixth speaker 176 in the second voice output section 153 have super-directivity with high straightness and sharp directivity. Therefore, the voice output from the third speaker 173 to the sixth speaker 176 mainly reaches the ears of the rider, but for the pillion passenger on the pillion passenger seat 53, the volume of the sound audible for the pillion passenger is lower than for the rider because the rider becomes an obstacle.

The first speaker 71 and second speaker 172 which constitute the first voice output section 151 are installed at the left end in the vehicle width direction and the seventh speaker 177 and eighth speaker 178 which constitute the third voice output section 155 are installed at the right end in the vehicle width direction. Therefore, the voice output from the first voice output section 151 and third voice output section 155 reaches the ears of the pillion passenger without the rider becoming an obstacle.

Referring back to FIG. 4, the description of the configuration of the controller 100 is continued.

The control section 110 is a computer device which includes a storage 120 and a processor 130. The storage 120 includes memories such as a ROM and RAM. ROM is an abbreviation for Read Only Memory. RAM: is an abbreviation for Random access memory. The storage 120 stores the control program to be executed by the processor 130. The storage 120 also stores the data processed at the time of execution of a computer program by the processor 130, and the processing result data. In addition, the storage 120 stores sound source data 123 reproduced by the sound source reproduction section 103.

The processor 130 includes a CPU, a microcomputer, a DSP and so on and controls various parts of the control section 110 by executing a program. CPU is an abbreviation for Central Processing Unit. DSP is an abbreviation for Digital Signal Processor. The processor 130 may be an SoC which integrates the processor 130 and storage 120. SoC is an abbreviation for System-on-a-chip.

The control section 110 implements various functional elements by the processor 130 executing the control program 121 stored in the storage 120. The control section 110 in this embodiment includes, as functional elements, a call control section 131 and a voice output control section 133.

As the call control section 131 receives a phone number input from the manipulation portion 40, it issues a call to the phone number by controlling the mobile communication section 101 and performs processing to establish a call with the other device. Also, as the call control section 131 receives a call connection request through the mobile communication section 101, it establishes a call with the other device by giving a reply.

The voice output control section 133 receives sensor data of the vehicle speed sensor 71.

The voice output control section 133 compares the vehicle speed of the vehicle 1 indicated by the received sensor data, with a first threshold and a second threshold which have been previously set. The first threshold is a threshold to determine whether or not to cause the speaker array 170 to output noise sound. The second threshold is a threshold to determine whether or not to stop output of the noise sound from the speaker array 170. The second threshold may be the same as, or different from, the first threshold. In this embodiment, an explanation is given of the case that the first threshold is set to 10 km/h and the second threshold is set to 30 km/h. However, these values can be changed arbitrarily.

When a call is established with the other device by control by the call control section 131 and the mobile communication section 101 receives voice data from the other device, the voice output control section 133 causes the first voice output section 151, second voice output section 153, and third voice output section 155 to output the voice based on the received voice data.

Then, with the call established with the other device, the voice output control section 133 determines whether or not the vehicle speed of the vehicle 1 indicated by the sensor data has gone down to the first threshold or less. When the vehicle speed of the vehicle 1 has gone down to the first threshold or less, the voice output control section 133 causes only the second voice output section 153 to output the voice based on voice data. The voice output control section 133 causes the first voice output section 151 and the third voice output section 155, which stop output of the voice based on the voice data, to output noise sound.

When the vehicle speed of the vehicle 1 is the first threshold or less, a third person walking or traveling on a bicycle at the left end of a road such as a pathway can hear the conversation of the occupant of the vehicle 1. Also, an occupant of another vehicle traveling on the lane on which the vehicle 1 is traveling or on a lane adjacent to that lane can hear the conversation of the occupant of the vehicle 1. In order to prevent the conversation of the occupant from being heard by the third person, the voice output control section 133 causes the first voice output section 151 and third voice output section 155 to output noise sound. The noise sound may be white noise or exhaust sound of the vehicle 1. Also, the noise sound may be music reproduced by the sound source reproduction section 103.

The speaker of the first voice output section 151 which outputs the noise sound may be the first speaker 171 and second speaker 172 or only the first speaker 171. Similarly, the speaker of the third voice output section 155 which outputs the noise sound may be the seventh speaker 177 and eighth speaker 178 or only the eighth speaker 178.

Also, the voice output section which outputs the noise sound may be only the first voice output section 151. In this case too, the speaker which outputs the noise sound may be the first speaker 171 and second speaker 172 or only the first speaker 171. In this case, the conversation can be prevented from being heard by a third person such as a pedestrian who is present at the left end of the road.

Then, when the vehicle 1 has stopped to wait for the traffic light to change or the like, the voice output control section 133 determines whether or not the vehicle 1 has started traveling. While the vehicle is stopped, if the call remains established with the other device and the second voice output section 153 is outputting the voice based on voice data, the voice output control section 133 determines whether or not the vehicle 1 has started traveling.

When the vehicle 1 has started traveling, the voice output control section 133 gradually lowers the sound volume of the noise sound to be output by the first voice output section 151 and third voice output section 155 as the vehicle speed of the vehicle 1 is increased. When the vehicle speed of the vehicle 1 becomes the second threshold or more, the voice output control section 133 causes the first voice output section 151 and third voice output section 155 to stop output of the noise sound and causes the first voice output section 151 and third voice output section 155 to output the voice based on voice data too. In other words, it causes the first voice output section 151, second voice output section 153, and third voice output section 155 to output the voice based on voice data.

Figure 8:
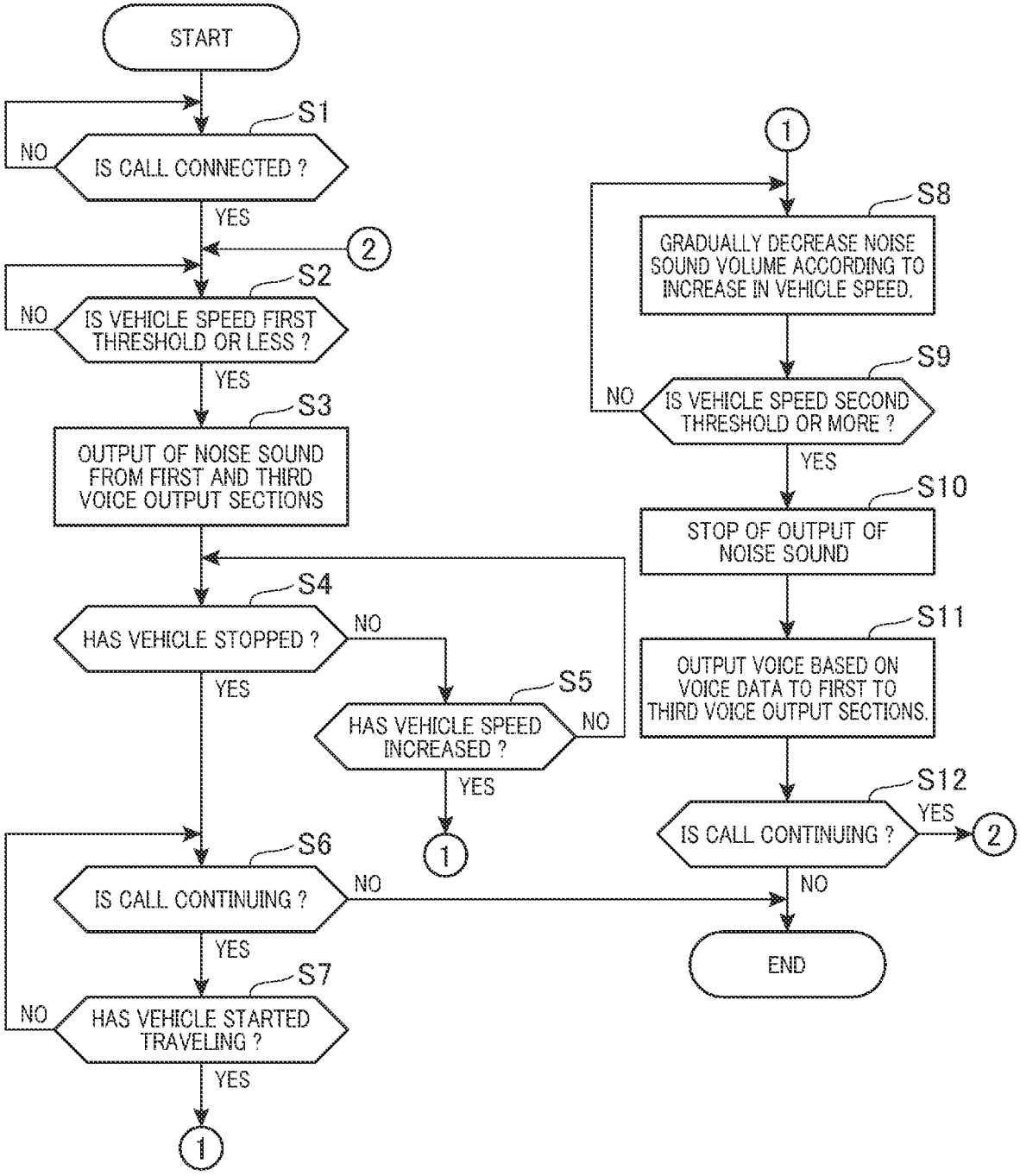
FIG. 8 is a flowchart which shows the operation of the control section 110.

Operation of the control section 110 is explained below, referring to the flowchart of FIG. 8. FIG. 8 is a flowchart which shows the operation of the control section 110.

First, the control section 110 determines whether or not a call is connected with the other device by a call-in or call request (Step S1). If a call is not connected (Step S1/NO), the control section 110 waits for connection of a call to start processing.

If a call is connected (Step S1/YES), the control section 110 acquires the sensor data of the vehicle speed sensor 71 and determines whether or not the vehicle speed of the vehicle 1 indicated by the acquired sensor data is the first threshold or less (Step S2). If the vehicle speed of the vehicle has not gone down to the first threshold or less (Step S2/NO), the control section 110 waits for the vehicle speed to go down to the first threshold or less.

If the vehicle speed of the vehicle 1 has gone down to the first threshold or less (Step S2/YES), the control section 110 causes the first voice output section 151 and third voice output section 155 to output noise sound (Step S3). Then, the control section 110 determines whether or not the vehicle 1 has stopped, according to the sensor data of the vehicle speed sensor 71 (Step S4).

If the vehicle 1 has not stopped (Step S4/NO), the control section 110 determines whether or not the vehicle speed of the vehicle 1 has increased (Step S5). If the vehicle speed of the vehicle 1 has not increased (Step S5/NO), the control section 110 goes back to Step 4 for determination. If the vehicle speed of the vehicle 1 has increased (Step S5/YES), the control section 110 goes to Step S8.

If the vehicle 1 has stopped (Step S4/YES), the control section 110 determines whether or not the call connection with the other device is maintained and the call is continuing (Step S6). If the call is not continuing (Step S6/NO), the control section 110 ends this processing flow.

If the call is continuing (Step S6/YES), the control section 110 determines whether or not the vehicle 1 has started traveling, according to the sensor data of the vehicle speed sensor 71 (Step S7). If the vehicle 1 has not started traveling (Step S7/NO), the control section 110 goes back to Step S6 for determination and determines whether or not the call is continuing.

If the vehicle 1 has started traveling (Step S7/YES), the control section 110 gradually lowers the sound volume of the noise sound according to the vehicle speed (Step S8). The control section 110 lowers the sound volume of the noise sound by a prescribed amount each time the vehicle speed increases by a prescribed speed. Then, the control section 110 determines whether or not the vehicle speed of the vehicle 1 becomes the second threshold or more (Step S9). If the vehicle speed is not the second threshold or more (Step S9/NO), the control section 110 carries out the process of Step S8.

If the vehicle speed is the second threshold or more (Step S9/YES), the control section 110 causes the first voice output section 151 and third voice output section 155 to stop output of the noise sound (Step S10). Then, the control section 110 causes the first voice output section 151, second voice output section 153, and third voice output section 155 to output the voice based on voice data (Step S11).

Then, the control section 110 determines whether or not the call is continuing (Step S12). If the call is ended (S12/NO), the control section 110 ends this processing flow. If the call is continuing (Step S12/YES), the control section 110 goes back to Step S2 for determination.

Figure 9:
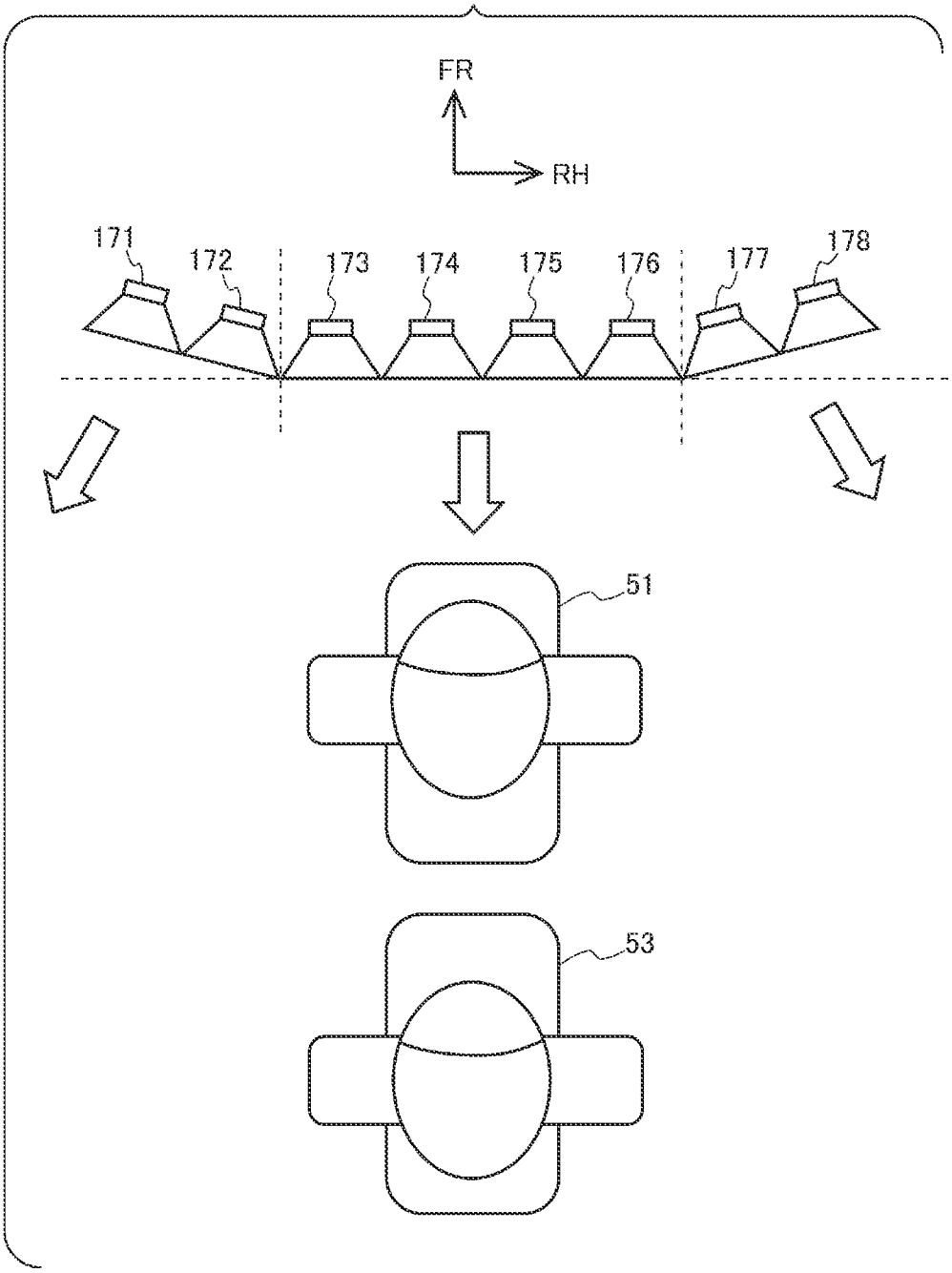
FIG. 9 is a diagram which shows another example of arrangement of the speaker array.
Figure 10:
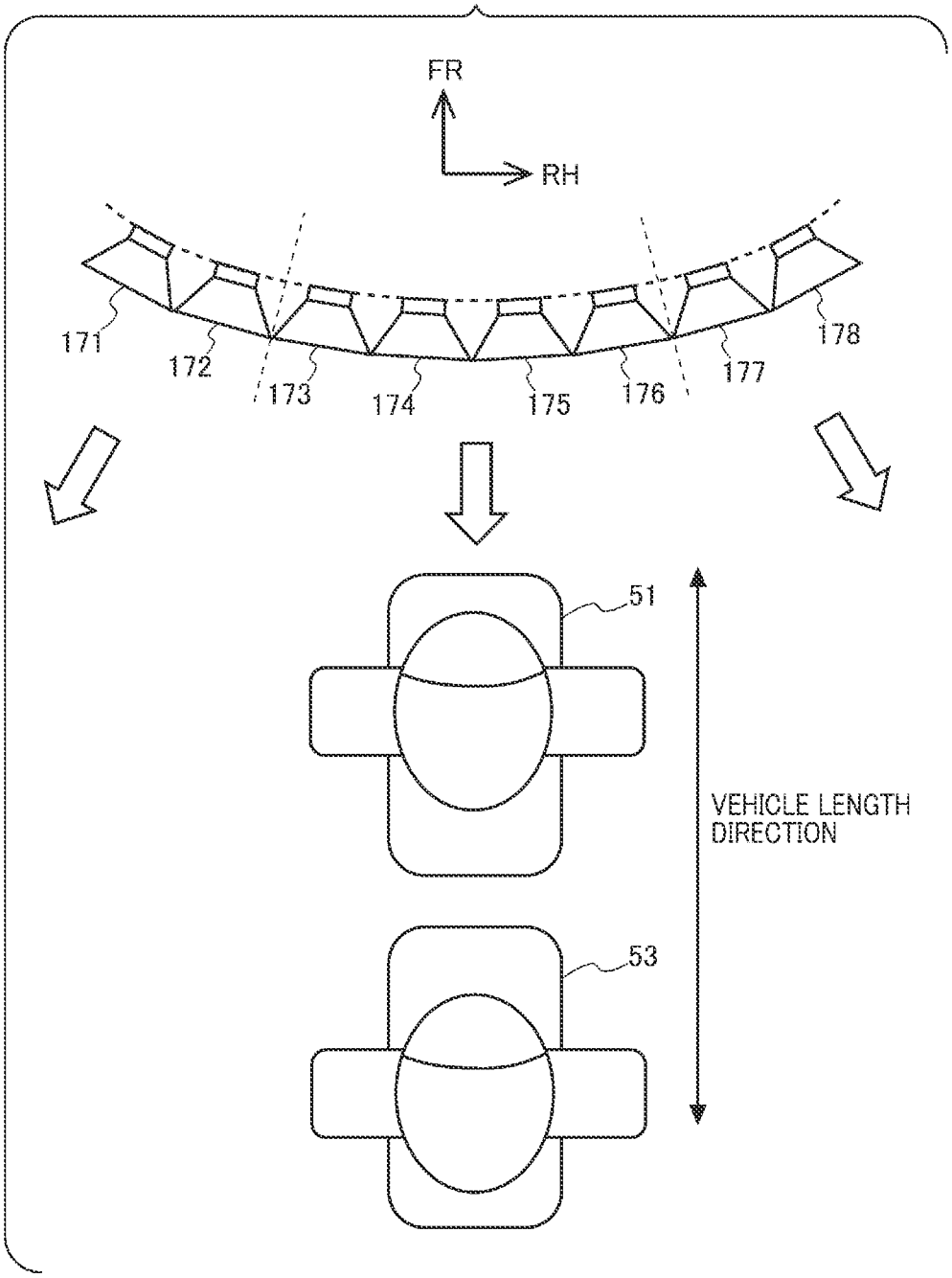
FIG. 10 is a diagram which shows another example of arrangement of the speaker array.

Here, other examples of arrangement of the first voice output section 151, second voice output section 153, and third voice output section 155 are explained referring to FIG. 9 and FIG. 10. FIG. 9 and FIG. 10 are diagrams which show other examples of arrangement of the speaker array 170.

FIG. 9 shows an example that the position of the second voice output section 153 is not changed and the positions of the first voice output section 151 and third voice output section 155 are changed. The first speaker 171 and second speaker 172 constituting the first voice output section 151 and the seventh speaker 177 and eighth speaker 178 constituting the third voice output section 155 are arranged in a manner to be oriented outward in the vehicle width direction of the vehicle 1.

The first speaker 171 and second speaker 172 are arranged in a manner to be oriented toward the left end in the road width direction. Therefore, the noise sound can be output on the left end side of the road effectively. Therefore, it is possible to enhance the effect to suppress the possibility that the content of the call is heard by a third person walking or traveling on a bicycle at the left end of the road.

The seventh speaker 177 and eighth speaker 178 are arranged in a manner to be oriented toward the right side in the width direction of the road, namely toward the adjacent lane. Therefore, the noise sound can be output on the right end side of the road effectively. This enhances the effect to suppress the possibility that the content of the call is heard by an occupant of a vehicle stopped on the adjacent lane. Furthermore, the size of the speaker array 170 in the vehicle width direction can be smaller than when the speaker array 170 is arranged in a row in the vehicle width direction of the vehicle 1 as shown in FIG. 7.

FIG. 10 shows an example that the first speaker 171 to the eighth speaker 178 are arranged in an arc-like manner to protrude toward the rider.

The positions of the first speaker 171, second speaker 172, seventh speaker 177 and eighth speaker 178 in the vehicle length direction are remoter from the rider than when they are arranged linearly as shown in FIG. 7. Also, in the speaker arrangement shown in FIG. 10 too, the first speaker 171 and second speaker 172 constituting the first voice output section 151 and the seventh speaker 177 and eighth speaker 178 constituting the third voice output section 155 are arranged in a manner to be oriented outward in the vehicle width direction of the vehicle 1. Therefore, it is possible to enhance the effect to suppress the possibility that the content of the call is heard by a third person. In addition, the size of the speaker array 170 in the vehicle width direction can be smaller than when the speaker array 170 is arranged in a row in the vehicle width direction of the vehicle 1 as shown in FIG. 7.

As explained above, the vehicle 1 in the first embodiment includes the plural voice output sections 151, 153 and 155 and the controller 100. In the controller 100, the voice output sections 151, 153 and 155 are arranged side by side in the vehicle width direction of the vehicle, and the controller 100 controls the plural voice output sections 151, 153, and 155.

The controller 100 includes the vehicle information input section 102 which receives vehicle speed information on the vehicle 1 and if the vehicle speed indicated by the vehicle speed information received by the vehicle information input section 102 is the first threshold or less, the controller 100 causes at least one of the plural voice output sections to output noise sound.

Therefore, it is possible to suppress the possibility that the voice is heard by a third person in the vehicle 1.

The first voice output section 151, second voice output section 153, and third voice output section 155 are arranged side by side in the vehicle width direction of the vehicle 1.

If the vehicle speed indicated by the vehicle speed information is the first threshold or less, the controller 100 causes the voice output sections 151 and 155 located outward in the vehicle width direction to output noise sound.

Therefore, it is possible to suppress the possibility that the voice is heard by a third person walking at an end in the width direction of the road on which the vehicle 1 is traveling, or on a pathway provided at an end of the road.

The controller 100 includes the voice input section 140 which receives a voice signal.

If the vehicle speed indicated by the vehicle speed information is the first threshold or less, the controller 100 causes the first voice output section 151 and third voice output section 155 to output noise sound and causes the second voice output section 153 to output voice based on the voice signal received by the voice input section 140, in which the first voice output section 151 and third voice output section 155 are located outward in the vehicle width direction and the second voice output section 153 is located between the first voice output section 151 and third voice output section 155.

Therefore, the occupant of the vehicle 1 can hear the voice received by the voice input section 140 and it is possible to suppress the possibility that the voice is heard by a third person walking at an end in the width direction of the road.

If the vehicle speed indicated by the vehicle speed information is the second threshold or more, the controller 100 causes the first voice output section 151, second voice output section 153, and third voice output section 155 to output voice based on the voice signal.

Therefore, if the vehicle speed of the vehicle 1 is the second threshold or more and the possibility of the voice received by the voice input section 140 being heard by a third person becomes low, the first voice output section 151 and third voice output section 155 also output the voice received by the voice input section 140 so that the occupant of the vehicle 1 can hear the voice received by the voice input section 140 more easily.

If the vehicle speed indicated by the vehicle speed information is less than the second threshold, the controller 100 controls the first voice output section 151 and third voice output section 155 to decrease the sound volume of the noise sound gradually according to an increase in the vehicle speed.

If the vehicle speed of the vehicle 1 increases and the possibility of the voice being heard by a third person becomes low, the noise sound is gradually lowered so that the occupant can hear the voice received by the voice input section 140 more easily.

The first voice output section 151, second voice output section 153, and third voice output section 155 include speakers 171 to 178.

The speakers 171, 172, 177 and 178 of the first voice output section 151 and third voice output section 155 are arranged in a manner to be oriented outward in the vehicle width direction.

Therefore, it is possible to output the noise sound outward in the width direction of the road effectively.

Second Embodiment

Next, the second embodiment of the present invention will be described referring to drawings.

Figure 11:
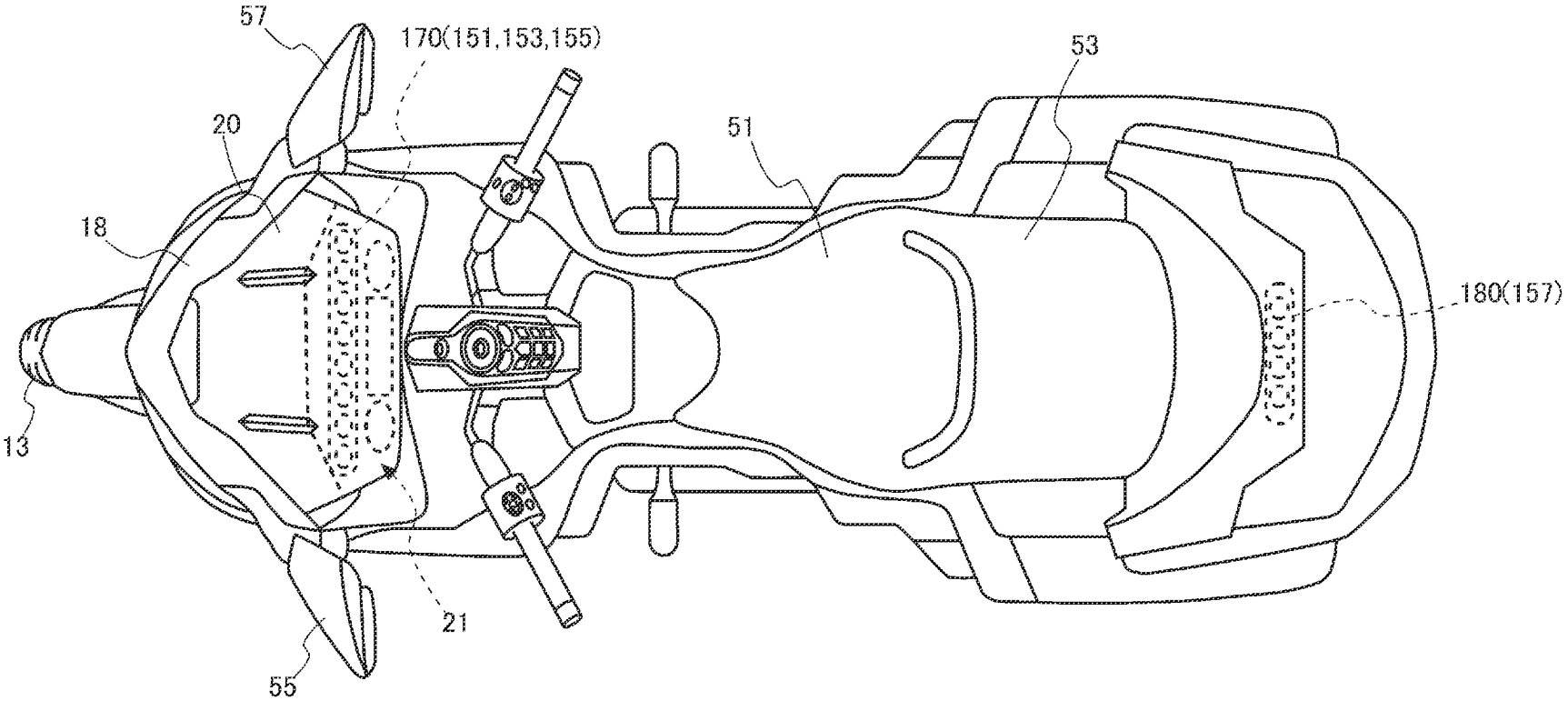
FIG. 11 is a top view which shows the structure of the vehicle according to the second embodiment.
Figure 12:
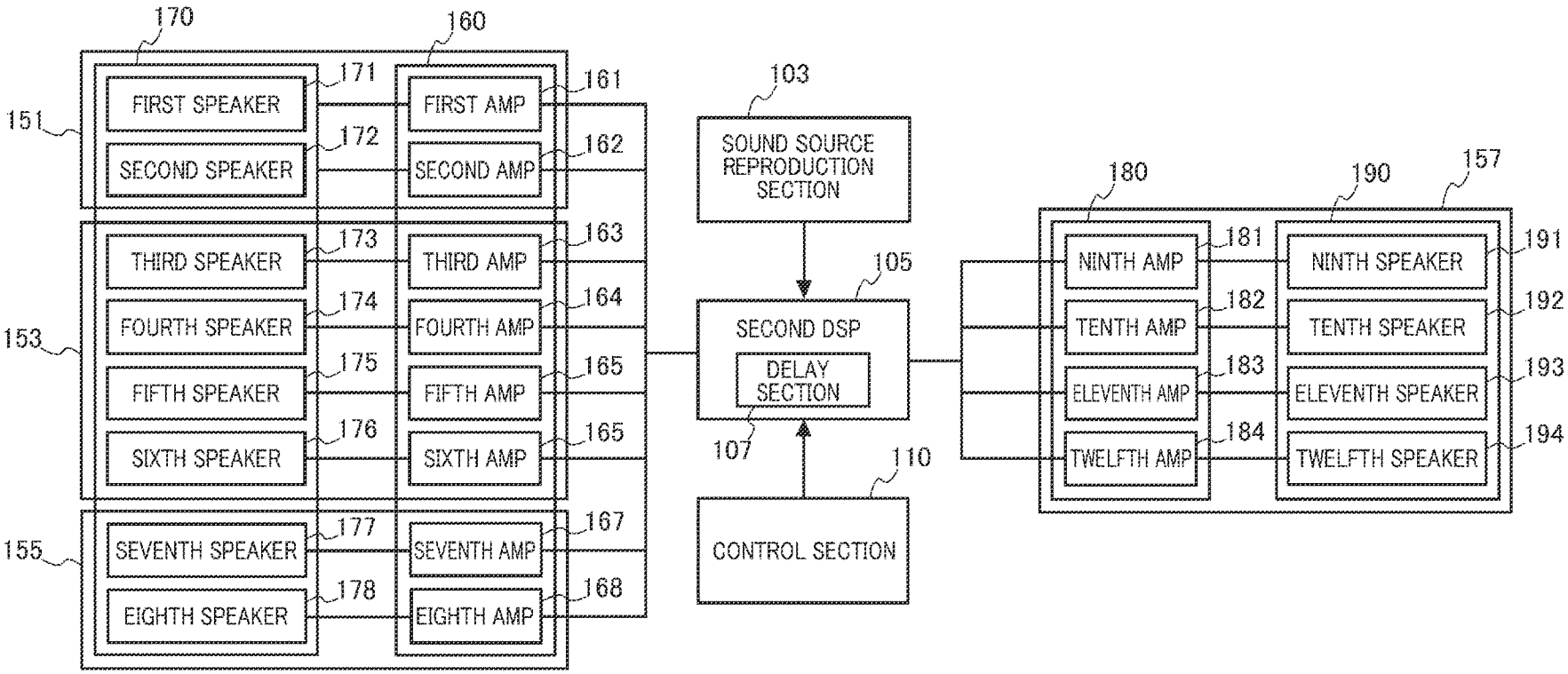
FIG. 12 is a diagram which shows the configuration of the voice output system according to the second embodiment.

FIG. 11 is a top view which shows the structure of the vehicle 1 according to the second embodiment. FIG. 12 is a diagram which shows the configuration of the voice output system according to the second embodiment.

The vehicle 1 according to the second embodiment includes a fourth voice output section 157 including a speaker array 180. The fourth voice output section 157 is located closer to the rear end in the vehicle length direction of the vehicle 1 than the rear end of the pillion passenger seat 53.

The first voice output section 151, second voice output section 153, and third voice output section 155 are located forward in the vehicle length direction of the vehicle 1 and the fourth voice output section 157 is located rearward in the vehicle length direction. The first voice output section 151, second voice output section 153, and third voice output section 155 output voice rearward in the vehicle length direction and the fourth voice output section 157 outputs voice forward in the vehicle length direction.

The fourth voice output section 157 includes a ninth AMP 181, a tenth AMP 182, an eleventh AMP 183 and a twelfth AMP 184, and a ninth speaker 191, a tenth speaker 192, an eleventh speaker 193, and a twelfth speaker 194 which constitute a speaker array 180.

The ninth AMP 181 is connected with the ninth speaker 191 and the voice signal amplified by the ninth AMP 181 is output by the ninth speaker 191.

The tenth AMP 182 is connected with the tenth speaker 192 and the voice signal amplified by the tenth AMP 182 is output by the tenth speaker 192.

The eleventh AMP 183 is connected with the eleventh speaker 193 and the voice signal amplified by the eleventh AMP 183 is output by the eleventh speaker 193.

The twelfth AMP 184 is connected with the twelfth speaker 194 and the voice signal amplified by the twelfth AMP 184 is output by the twelfth speaker 194.

The ninth speaker 191, tenth speaker 192, eleventh speaker 193, and twelfth speaker 194 which constitute the fourth voice output section 157 are located in a position to face the second voice output section 153. In addition, in the second embodiment, the first DSP 104 is replaced by a second DSP 105.

The second DSP 105 has an active noise control function. The second DSP 105 generates control sound with an opposite phase to the voice data received from the control section 110 and causes the fourth voice output section 157 to output the generated opposite phase control sound. This can suppress the possibility that the voice based on voice data as output from the second voice output section 153 is heard by the pillion passenger on the pillion passenger seat 53. In other words, only the rider sitting on the rider seat 51 can hear the voice based on the voice data and the pillion passenger on the pillion passenger seat 53 cannot hear the voice based on the voice data.

The second DSP 105 includes a delay section 107. The delay section 107 is a functional section which delays the timing of output of the voice based on the voice data from the second voice output section 153. Specifically, the delay section 107 is a functional section which synchronizes the timing of voice output from the second voice output section 153 with the timing of output of a control signal with an opposite phase from the fourth voice output section 157.

As the second DSP 105 generates an analog voice signal based on the voice data received from the control section 110, it enters the generated voice signal into the delay section 107. The delay section 107 delays the timing of input of the received voice signal into the third AMP 163, fourth AMP 164, fifth AMP 165, and sixth AMP 166, by a preset delay time. The delay time setting can be changed arbitrarily, for example, by manipulation with the manipulation portion 40.

As explained above, the vehicle 1 according to the second embodiment includes the first voice output section 151, second output section 153, and third voice output section which are located forward in the vehicle 1, and the fourth voice output section 157 which is located rearward in the vehicle 1.

The first voice output section 151, second voice output section 153, and third voice output section 155 are arranged side by side in the vehicle width direction and output voice rearward in the vehicle 1, and the fourth voice output section 157 is located in a position to face the second voice output section 153 with the seats 51 and 53 of the vehicle 1 for the occupants to sit on being sandwiched.

The controller 100 includes the voice input section 140 which receives a voice signal, and the controller 100 causes the second voice output section 153 to output the voice based on the voice signal received by the voice input section 140 to the second voice output section 153 and causes the fourth voice output section 157 to output the voice with an opposite phase to the voice based on the voice signal.

Therefore, it is possible to suppress the possibility that the voice received by the voice input section 140 is heard by the pillion passenger of the vehicle 1.

If the vehicle speed indicated by vehicle speed information is the first threshold or less, the controller 100 causes the first voice output section 151 and third voice output section 155 located outward in the vehicle width direction to output noise sound and causes the second voice output section 153 located between the first voice output section 151 and third voice output section 155 to output the voice based on the voice signal received by the voice input section 140.

Therefore, the occupant of the vehicle 1 can hear the voice received by the voice input section 140 and it is possible to suppress the possibility that the voice received by the voice input section 140 is heard by a third person walking at an end in the width direction of the road.

The controller 100 includes the delay section 107 which delays the timing of voice output.

The controller 100 delays the timing of voice output from the second voice output section 153 so that the timing of voice output from the second voice output section 153 is the timing of voice output from the fourth voice output section 157.

Therefore, the timing of output of voice with an opposite phase from the fourth voice output section 157 can coincide with the timing of voice output from the second voice output section 153 and thus it is possible to enhance the effect to suppress the possibility that the conversation of the rider is heard by the pillion passenger.

The abovementioned embodiments are preferred embodiments of the present invention. However, the gist of the present invention is not limited to the abovementioned embodiments and can be embodied in other various forms.

REFERENCE SIGNS LIST

1 . . . Vehicle
10 . . . Body frame
11 . . . Power unit
12 . . . Front fork
13 . . . Front wheel
14 . . . Steering handlebar
15 . . . Swing arm
16 . . . Rear wheel
18 . . . Body cover
20 . . . Front screen
21 . . . Meter panel
25 . . . Measuring instrument
26 . . . Measuring instrument
27 . . . Display
40 . . . Manipulation portion
41 . . . Handlebar manipulation portion
42 . . . Handlebar manipulation portion
43 . . . Center manipulation portion
51 . . . Rider seat
53 . . . Pillion passenger seat
55 . . . Left mirror
57 . . . Right mirror
71 . . . Vehicle speed sensor
100 . . . Controller
101 . . . Mobile communication section
102 . . . Vehicle information input section
103 . . . Sound source reproduction section
107 . . . Delay section
110 . . . Control section
120 . . . Storage
121 . . . Control program
123 . . . Sound source data
130 . . . Processor
131 . . . Call control section
133 . . . Voice output control section
140 . . . Voice input section
145 . . . Controller board
151 . . . First voice output section
153 . . . Second voice output section
155 . . . Third voice output section
157 . . . Fourth voice output section
160 . . . Signal amplifying section
170 . . . Speaker array
171 . . . First speaker
172 . . . Second speaker
173 . . . Third speaker
174 . . . Fourth speaker
175 . . . Fifth speaker
176 . . . Sixth speaker
177 . . . Seventh speaker
178 . . . Eighth speaker
180 . . . Speaker array
191 . . . Ninth speaker
192 . . . Tenth speaker
193 . . . Eleventh speaker
194 . . . Twelfth speaker
161 . . . First AMP 161
162 . . . Second AMP 162
163 . . . Third AMP 163
164 . . . Fourth AMP 164
165 . . . Fifth AMP 165
166 . . . Sixth AMP 166
167 . . . Seventh AMP 167
168 . . . Eighth AMP 168
181 . . . Ninth AMP
182 . . . Tenth AMP
183 . . . Eleventh AMP
184 . . . Twelfth AMP
104 . . . First DSP
105 . . . Second DSP

The invention claimed is:

1. A vehicle comprising a plurality of speakers arranged side by side in a vehicle width direction of the vehicle, wherein the plurality of speakers include a first speaker, a second speaker, and a third speaker, wherein the vehicle includes a voice input circuit which receives a voice signal, and wherein if a vehicle speed is a first threshold or less, the vehicle causes the first speaker and the third speaker to output a noise sound and causes the second speaker to output a voice sound based on the voice signal received by the voice input circuit, and wherein the first speaker and the third speaker are located relatively outward in the vehicle width direction while the second speaker is located between the first speaker and the third speaker.

2. The vehicle according to claim 1, wherein if the vehicle speed is a second threshold or more, the vehicle causes the first speaker, the second speaker, and the third speaker to output the voice sound based on the voice signal.

3. The vehicle according to claim 2, wherein if the vehicle speed is less than the second threshold, the vehicle controls the first speaker and the third speaker to decrease a sound volume of the noise sound gradually according to an increase in the vehicle speed.

4. The vehicle according to claim 1, wherein the first speaker and the third speaker are oriented outward in the vehicle width direction.

5. The vehicle according to claim 1, wherein the plurality of speakers include the first speaker, the second speaker, the third speaker, and a fourth speaker, and wherein, among the plurality of speakers, the first speaker, the second speaker, and the third speaker are located relatively forward in the vehicle and the fourth speaker is located relatively rearward in the vehicle, wherein the first speaker, the second speaker, and the third speaker are arranged side by side in the vehicle width direction and output the voice sound rearwardly in the vehicle, wherein the fourth speaker is disposed such that a seat for an occupant to sit on is located between the fourth speaker and the second speaker wherein the vehicle causes the second speaker to output the voice sound based on the voice signal received by the voice input circuit, and wherein the vehicle causes the fourth speaker to output the voice sound with an opposite phase to the voice sound based on the voice signal.

6. The vehicle according to claim 5, wherein if the vehicle speed is the first threshold or less, the vehicle causes the first speaker and the third speaker to output the noise sound and causes the second speaker to output the voice sound based on the voice signal received by the voice input circuit, and wherein among the plurality of speakers, the first speaker and the third speaker are located relatively outward in the vehicle width direction and the second speaker is located between the first speaker and the third speaker.

7. The vehicle according to claim 6, wherein the vehicle includes a processor which delays timing of voice output, and wherein the timing of voice output from the second speaker is delayed to make the timing of voice output from the second speaker be the timing of voice output from the fourth speaker.

8. A vehicle comprising a plurality of speakers arranged side by side in a vehicle width direction of the vehicle, wherein the plurality of speakers include a first speaker, a second speaker, a third speaker, and a fourth speaker, the first speaker, the second speaker, and the third speaker being located relatively forward in the vehicle while the fourth speaker is located relatively rearward in the vehicle among the plurality of speakers, wherein the first speaker, the second speaker, and the third speaker are arranged side by side in the vehicle width direction and output voice rearward in the vehicle, wherein the fourth speaker is disposed such that a seat for an occupant to sit on is located between the fourth speaker and the second speaker, wherein the vehicle causes the second speaker to output voice based on a voice signal received by a voice input circuit, wherein the vehicle causes the fourth speaker to output voice with an opposite phase to the voice based on the voice signal, wherein if the vehicle speed is a first threshold or less, the vehicle causes the first speaker and the third speaker to output a noise sound and causes the second speaker to output voice based on the voice signal received by the voice input circuit, the first speaker and the third speaker being located outward in the vehicle width direction among the plurality of speakers and the second speaker being located between the first speaker and the third speaker.

* * * * *